United States Patent [19]

Koga

[11] Patent Number: 4,655,189

[45] Date of Patent: Apr. 7, 1987

[54] DEVICE FOR PROCESSING FUEL VAPOR

[75] Inventor: Itsuo Koga, Okazaki, Japan

[73] Assignee: Toyota Jidosha Kabushiki Kaisha, Toyota, Japan

[21] Appl. No.: 717,007

[22] Filed: Mar. 28, 1985

[30] Foreign Application Priority Data

Mar. 31, 1984 [JP] Japan ..... 59-045876[U]
Feb. 2, 1985 [JP] Japan ..... 60-013013[U]

[51] Int. Cl.[4] ..... F02M 33/02

[52] U.S. Cl. ..... 123/519; 55/182; 55/387

[58] Field of Search ..... 123/519, 520, 521, 518, 123/DIG. 2; 55/182, 189, 387, 316

[56] References Cited

U.S. PATENT DOCUMENTS

| | | | |
|---|---|---|---|
| 4,083,344 | 4/1978 | Sakurai et al. | 123/520 |
| 4,331,120 | 5/1982 | Hiramatu et al. | 123/519 |
| 4,454,849 | 6/1984 | Mizuno et al. | 123/519 |
| 4,507,132 | 3/1985 | Yoshida | 55/387 |

FOREIGN PATENT DOCUMENTS 55-45748 11/1980 Japan .

*Primary Examiner*—Craig R. Feinberg
*Assistant Examiner*—David A. Okonsky
*Attorney, Agent, or Firm*—Finnegan, Henderson, Farabow, Garrett & Dunner

[57] ABSTRACT

A device for processing fuel vapor including a canister and a separating mechanism. The canister houses an absorbent such as charcoal for absorbing vapor components of the fuel vapor. The separating mechanism separates the fuel vapor into liquid components and vapor components. The separating mechanism has a separating chamber holding the liquid component, a lead tube for leading the fuel vapor from a fuel tank to the separating chamber, an outlet tube through which the vapor component in the canister flows into the separating chamber, and an inlet tube through which the vapor component in the separating chamber flows into the canister. The end opening of the lead tube is located close to the bottom of the separating chamber, and the end openings of the inlet and outlet tubes are located close to the ceiling of the separating chamber and above the surface of the liquid component in the separating chamber.

5 Claims, 4 Drawing Figures

DEVICE FOR PROCESSING FUEL VAPOR

BACKGROUND OF THE INVENTION

1. Field of the Invention

The present invention relates to a device for processing fuel vapor. More particularly, it relates to a device which collects and traps fuel vapor emitted from, for example, a fuel tank of an internal combustion engine, and discharges the fuel vapor to the fuel tank or a carburetor inlet pipe.

2. Description of the Related Art

Fuel vapor accumulated in, for example, a fuel tank, should not be directly discharged to the atmosphere, since this results not only in atmospheric pollution but also in an increase in fuel consumption. In an attempt to eliminate this problem, Japanese Examined Patent Publication (Kokoku) No. 55-45748 discloses a construction for collecting fuel vapor wherein a canister housing containing, for example, charcoal as an absorbent, is provided between a fuel tank and an intake passage of a carburetor. However, in this construction wherein the canister is simply connected to the fuel tank, if the automobile body is severely jolted, liquid fuel in the fuel tank will impinge on a check valve provided in an inlet portion of the canister, and as a result, plasticizer in a flexible hose connected between the fuel tank and the inlet portion of the canister is dissolved into the liquid fuel flowing in the hose, and this plasticizer may impinge on and adhere to the check valve. If the plasticizer adheres to the check valve, the valve seat becomes sticky and the valve becomes hard to open, lowering the efficiency of the operation of the valve.

SUMMARY OF THE INVENTION

Therefore, it is an object of the present invention to provide a device by which the liquid fuel does not come into contact with the check valve and thus operation of the valve is kept at a normal status.

According to the present invention, there is provided a device comprising: a canister housing an absorbent for absorbing vapor components of a fuel from, for example, a fuel tank, and separating means which separates the fuel into liquid components and vapor components. The separating means is provided between the canister and a portion where the fuel is stored, and has a separating chamber in which the liquid component is held to prevent it from flowing into the canister, a lead tube communicated with the portion where the fuel is stored, an inlet tube through which the vapor component in the separating chamber flows into the canister, and an outlet tube through which part of the vapor component in the canister flows into the separating chamber. The lead tube is located near the bottom of the separating chamber, and the end openings of the inlet and outlet tubes are located above the surface of the liquid component contained in the separating chamber.

BRIEF DESCRIPTION OF THE DRAWINGS

The present invention will be better understood from the ensuing description made, by way of example, of the embodiments of device according to the present invention with reference to the accompanying drawings, wherein.

DESCRIPTION OF THE PREFERRED EMBODIMENTS

Figure 1:
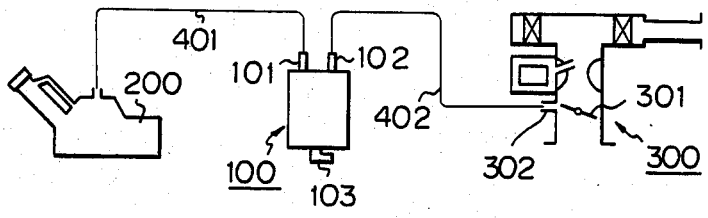
FIG. 1 shows connections between a device for processing a fuel vapor, a fuel tank, and a carburetor.

FIG. 1 shows a device 100 for processing a fuel vapor connected to a fuel tank 200 and an intake passage of a carburetor 300. In this figure, a tank port 101 of the device 100 is connected to the fuel tank 200 through a tube 401, while a purge port 102 of the device 100 is connected through a tube 402 to a discharge port 302 opening near a throttle valve 301 in the intake passage of the carburetor 300. An air port 103 provided under a portion of the device 100 opens to the atmosphere.

If pressure in the fuel tank 200 is relatively high, fuel vapor flows from the tank 200 to the device 100. But, if the pressure in the tank 200 becomes relatively low, liquid fuel in the device 100 flows into the tank 200. If a negative pressure is generated at an outlet portion of the discharge hole 302 during operation of the engine, fuel vapor in the device 100 is sucked through the purge port 102 and the tube 402 and discharged to the throttle valve 301 through the discharge port 302.

Figure 2:
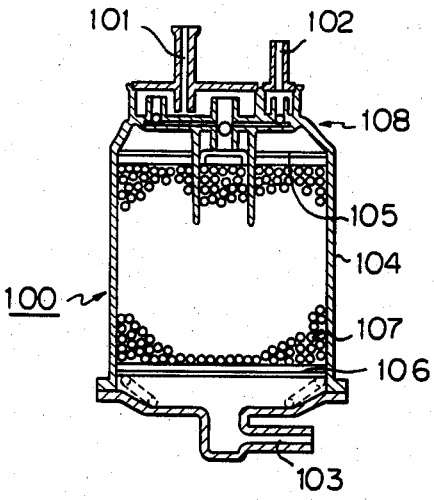
FIG. 2 is a sectional view of a first embodiment of the present invention.

FIG. 2 shows the construction of the device 100. In this figure, a canister 104 has two ventilative holding plates 105 and 106 therein, and an absorbent 107 for absorbing fuel vapor, for example, charcoal, is contained between the plates 105 and 106. Above the canister 104, a separating mechanism 108 for separating a fuel into liquid components and vapor components is provided.

Figure 3:
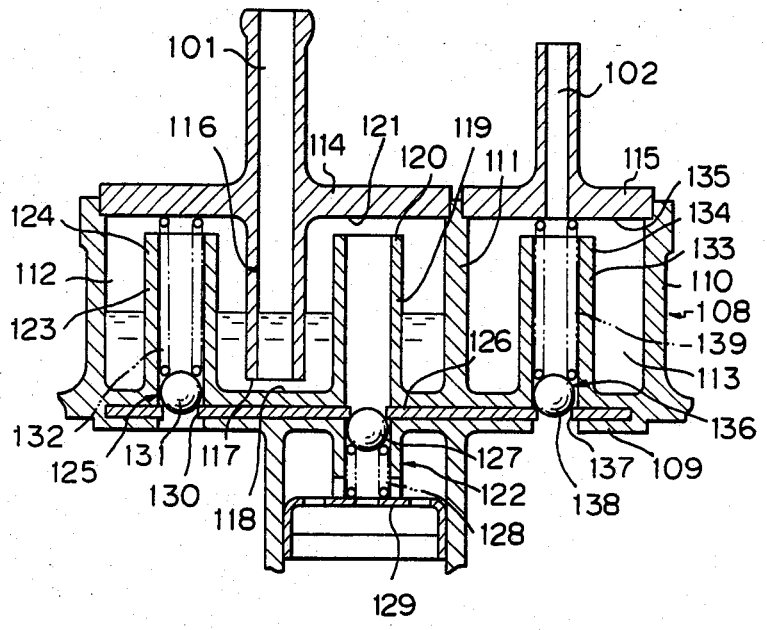
FIG. 3 is a sectional view of a main top section of the first embodiment of FIG. 2.

As shown in detail in FIG. 3, the separating mechanism 108 includes a disk shaped lower wall 109, a cylindrical outer wall 110 formed on the outer periphery of the lower wall 109, and a partition wall 111 formed inside the outer wall 110 and dividing the interior of the outer wall 110 into a separating chamber 112 and a purge chamber 113. The upper opening of the separating chamber 112 is closed by an upper cover 114 having a fuel tank port 101, and the upper opening of the purge chamber 113 is closed by an upper cover 115 having the purge port 102. The separating chamber 112 holds the liquid components of a fuel vapor.

A lead tube 116 formed in a ceiling 121, i.e., the under surface of the upper cover 114, to communicate with the fuel tank port 101, extends straight downward; the lower end opening 117 of the tube 116 being close to the upper surface of the lower wall 109, i.e., near the bottom surface 118. An inlet tube 119 formed in a center of the lower wall 109 to communicate the separating chamber 112 and the canister 104 extends upward from the bottom surface 118, the upper end opening 120 of the tube 119 being close to the ceiling 121 of the separating chamber 112. The inlet tube 119 is provided with a first check valve 122 which permits fuel vapor to flow only from the separating chamber 112 to the canister 104. An outlet tube 123 is formed in an end portion of the lower wall 109 to communicate the separating chamber 112 and the canister 104, similar to the inlet tube 119, and extends upward from the bottom surface 118, the upper end opening 124 being close to the ceiling 121. The outlet tube 123 is provided with a second check valve 125 which permits fuel vapor to flow only from the canister 104 to the separating chamber 112.

The first check valve 122 is provided with a ball valve 127, which seats on a valve seat 126, and a spring 128. The spring 128 is provided between a retainer 129 and the ball valve 127, to bias the ball valve 127 toward the valve seat 126. The ball valve 127 is separated from the valve seat 126 against the pressure of the spring 128, to open the inlet tube 119, when pressure in the fuel tank port 101 becomes higher than the pressure in the canister 104 by a constant value. Similarly, the second check valve 125 is provided with a ball valve 131 which seats on a valve seat 130, and a spring 132 which biases the ball valve 131 toward the valve seat 130, the ball valve 131 allowing the outlet tube 123 to open when pressure in the fuel tank port 101 becomes lower than the pressure in the canister 104 by a constant value.

Also in the purge chamber 113, an outlet tube 133 similar to the outlet tube 123 is formed. This outlet tube 133 projects upward from the bottom surface 118, the upper end opening 134 of the tube 133 being close to a ceiling 135 of the upper cover 115. A third check valve 136 is provided in the outlet tube 133. This check valve 136 permits vapor components only to flow from the canister 104 to the purge port 102. That is, the third check valve 136 has a ball valve 138 which seats on a valve seat 137, and a spring 139 which biases the ball valve 138 toward the valve seat 137, the ball valve 138 allowing the outlet tube 133 to open when pressure in the purge port 102 becomes lower than the pressure in the canister 104 by a constant value.

Operation of the above-described embodiment is as follows.

When vapor pressure of the fuel in the fuel tank 200 is high, fuel vapor generated in the fuel tank 200 flows into the separating chamber 112 through the fuel tank port 101. During the passage of the fuel vapor through the tube 401, the vapor is cooled and partly liquefied. The liquid components enter the separating chamber 112 with the vapor components and are held in the chamber 112. A vapor component of the fuel exerts pressure on and opens the first check valve 122 and flows into the canister 104 through the inlet tube 119. At this point, although a liquid component including plasticizer extracted from the hose forming the tube 401 may flow into the separating chamber 112, this liquid component cannot flow into the inlet tube 119 and the outlet tube 123, because the upper end opening 120 of the inlet tube 119 and the upper end opening 124 of the outlet tube 123 are located above the surface of the liquid in the separating chamber 112. Therefore, the plasticizer will not stick to the first and second check valves 122, 125, and thus the valves 127 and 131 are ensured of a proper contact with and parting from the valve seats 126 and 130.

Conversely, when the temperature of the fuel is reduced, and thus a negative pressure is generated in the fuel tank 200, the liquid component in the separating chamber 112 is sucked through the tank port 101 and returned to the fuel tank 200. The liquid component in the separating chamber 112 is effectively returned to the fuel tank 200 because the lower end opening 117 of the lead tube 116 is located adjacent to the bottom surface 118 of the separating chamber 112. This operation ensures that the liquid surface in the separating chamber 112 is rapidly lowered, and thus the liquid component in the separating chamber 112 is prevented from entering the inlet tube 119 and the outlet tube 123, and thus will not come into contact with the first and second check valves 122 and 125.

Meanwhile, if a negative pressure is formed inside of the intake passage carburetor 300, the third check valve 136 in the outlet tube 133 is opened by this negative pressure transmitted through the purge port 102. As a result, the fuel vapor in the canister 104 is discharged to the intake passage of the carburetor 300 through the outlet tube 133, the purge port 102, and the tube 402.

Preferably, the lower end opening 117 of the lead tube 116 should be positioned as close as possible to the bottom surface 118, to gain the full effect of the lead tube 116 when the liquid component in the separating chamber 112 is withdrawn by negative pressure in the fuel tank 200.

Figure 4:
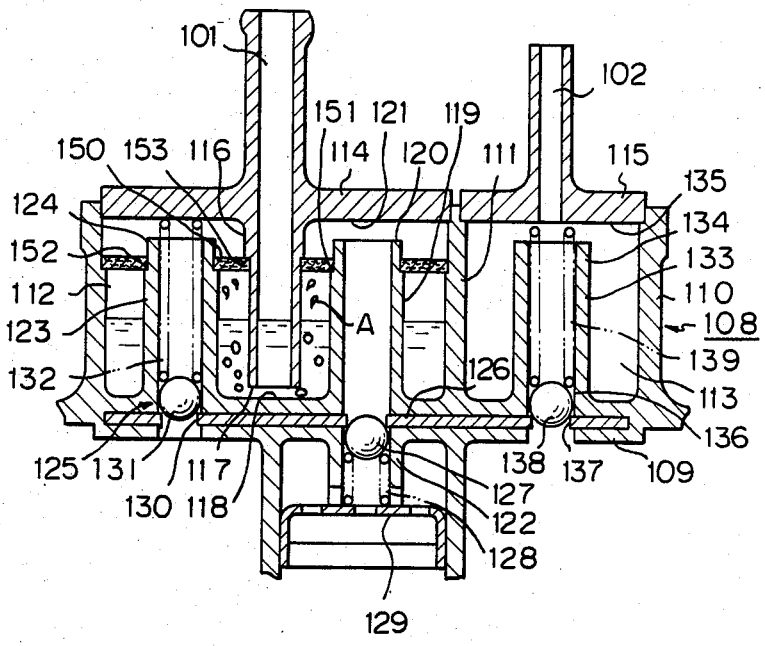
FIG. 4 is a sectional view of a main top section of a second embodiment of the present invention.

FIG. 4 shows a second embodiment of the present invention, which has the same construction as the first embodiment except for a filter 150 provided in the separating chamber 112. The filter 150 has a plate shape, and is placed a little below the upper end of the inlet and outlet tubes 119 and 123 in such a manner that the inlet tube 119, the outlet tube 123, and the lead tube 116 extend through the filter 150. The upper portions of the inlet and outlet tubes 119 and 123 are provided with step-like portions 151 and 152, and a similar step-like portion 153 is provided on a root portion of the lead tube 116, this portion 153 being located in the vicinity of the ceiling 121 and a little above the step-like portions 151 and 152. Thus, the filter 150 is held between the step-like portions 151 and 152 and the step like-portion 153. That is, the filter 150 is provided between the end openings 120 and 124 of the inlet and outlet tubes 119 and 123 and the surface of the liquid component in the separating chamber 112 in such a manner that it covers the surface of the liquid component. The filter 150 allows only the vapor component to pass therethrough, and thus prevents the liquid component from entering the inlet and outlet tubes 119 and 123.

Therefore, even if splashing occurs (shown as A in the figure) in the separating chamber 122 when fuel vapor flows into the chamber 122 through the tank port 101, this splashing A will impinge only on the filter 150 and will not enter the inlet and outlet tubes 119 and 123. Similarly, liquid components which may contain plasticizer extracted from the hose of the tube 401 will not enter the inlet and outlet tubes 119 and 123, and thus plasticizer will not adhere to the first and second check valves 122 and 125.

Although embodiments of the present invention have been described herein with reference to the attached drawings, many modifications and changes may be made by those skilled in this art without departing from the scope of the invention.

I claim:

1. A device for processing a fuel vapor comprising:

a canister having an absorbent for absorbing components of the fuel vapor; and means for separating the fuel vapor into liquid components and vapor components, said separating means being provided between said canister and a fuel vapor source, said separating means having a separating chamber in which the liquid component is held to prevent it from flowing into said canister, a lead tube communicating said fuel vapor source with said separating chamber, an inlet tube through which the vapor component in said separating chamber flows into said canister, and an outlet tube through which a portion of the vapor component in said canister flows into said separating chamber, said lead tube extending downward from a ceiling of said separating chamber, an end opening of said lead tube being positioned near a bottom of said separating chamber, an end opening of each of said inlet and outlet tubes being located above the surface of the liquid component.

2. A device according to claim 1, wherein said inlet and outlet tubes extend upward from the bottom of said separating chamber, the end openings of said inlet and outlet tubes being positioned near the ceiling of said separating chamber.

3. A device according to claim 1, wherein said inlet tube is provided with a first check valve permitting the vapor component only to flow from said separating chamber to said canister, and said outlet tube is provided with a second check valve permitting the vapor component only to flow from said canister to said separating chamber.

4. A device according to claim 1, further comprising means for preventing the liquid component in said separating chamber from entering said inlet and outlet tubes.

5. A device for processing a fuel vapor comprising:

a canister housing an absorbent for absorbing vapor components of the fuel vapor;

means for separating the fuel vapor into liquid components and vapor components, said separating means being provided between said canister and a fuel vapor source, said separating means having a separating chamber in which the liquid component is held to prevent it from flowing into said canister, a lead tube communicating said fuel vapor source with said separating chamber, an inlet tube through which the vapor component in said separating chamber flows into said canister, and an outlet tube through which a portion of the vapor component in said canister flows into said separating chamber, said lead tube extending near to a bottom of said separating chamber, an end opening of lack of said inlet and outlet tubes being located above the surface of the liquid component; and a filter plate located at a level between both of the end openings of said inlet and outlet tubes and the surface of the liquid component in said separating chamber, said filter plate covering the surface of the liquid component.

* * * * *